US010316702B2

(12) United States Patent
Brune et al.

(10) Patent No.: US 10,316,702 B2
(45) Date of Patent: Jun. 11, 2019

(54) ROCKER ARM ASSEMBLY AND METHOD OF FORMING RETENTION ELEMENTS IN A ROCKER ARM

(71) Applicant: GT Technologies, Westland, MI (US)

(72) Inventors: John Edmund Brune, Stockbridge, MI (US); Scott P. Smith, Temperance, MI (US)

(73) Assignee: GT Technologies, Westland, MI (US)

( * ) Notice: Subject to any disclaimer, the term of this patent is extended or adjusted under 35 U.S.C. 154(b) by 114 days.

(21) Appl. No.: 15/259,655

(22) Filed: Sep. 8, 2016

(65) Prior Publication Data

US 2016/0376937 A1 Dec. 29, 2016

Related U.S. Application Data

(63) Continuation-in-part of application No. 15/065,644, filed on Mar. 9, 2016, now Pat. No. 10,001,034.
(Continued)

(51) Int. Cl.

| | |
|---|---|
| ***F01L 1/14*** | (2006.01) |
| ***F01L 1/24*** | (2006.01) |
| ***F01L 1/18*** | (2006.01) |
| *F01L 1/053* | (2006.01) |
| *F01L 13/00* | (2006.01) |
| *F01L 1/047* | (2006.01) |

(52) U.S. Cl.
CPC ..... *F01L 1/2405* (2013.01); *F01L 1/185* (2013.01); *F01L 2001/0471* (2013.01);
(Continued)

(58) Field of Classification Search
CPC ..... F01L 1/2405; F01L 1/185; F01L 1/053; F01L 2103/01; F01L 2101/00;
(Continued)

(56) References Cited

U.S. PATENT DOCUMENTS 1,302,075 A1 10/2001 Krieg et al.
6,932,040 B2 * 8/2005 Kadokawa ..... B21D 53/84 123/90.39
(Continued)

FOREIGN PATENT DOCUMENTS

DE 102012219506 A1 4/2014
DE 102013212076 A1 1/2015
(Continued)

OTHER PUBLICATIONS

International Search Report and Written Opinion of the International Searching Authority for PCT International Application No. PCT/US2016/021760 dated Jun. 21, 2016.
(Continued)

*Primary Examiner* — Zelalem Eshete
(74) *Attorney, Agent, or Firm* — Howard & Howard Attorneys PLLC

(57) ABSTRACT

An assembly for a valvetrain having a valve, a lash adjuster, and a lobe. The assembly includes a shaft, a bearing supported by the shaft for engaging the lobe, and a rocker having a pad for the valve and a socket for the lash adjuster. Walls are disposed between the pad and socket, have inner and outer wall surfaces, and define a valley for the shaft. Upwardly-opening arc-shaped bearing surfaces are disposed longitudinally between the pad and socket spaced laterally from each other and support the shaft when the bearing engages the lobe. A retention element formed in each wall with a depressed portion spaced from the outer wall surface and a lip portion arranged under the depressed portion extends into the valley above the bearing surfaces such that the shaft is prevented from moving out of the valley in absence of engagement between the bearing and the lobe.

14 Claims, 10 Drawing Sheets

Related U.S. Application Data

(60) Provisional application No. 62/131,023, filed on Mar. 10, 2015.

(52) U.S. Cl.
CPC ..... *F01L 2001/0535* (2013.01); *F01L 2013/0052* (2013.01); *F01L 2103/01* (2013.01); *F01L 2105/02* (2013.01); *F01L 2250/02* (2013.01); *F01L 2250/04* (2013.01); *F01L 2810/02* (2013.01)

(58) Field of Classification Search
CPC ..... F01L 2001/0471; F01L 2810/02; F01L 2001/0535; F01L 2013/0052; F01L 2105/02; F01L 2250/02; F01L 2250/04
See application file for complete search history.

(56) References Cited

U.S. PATENT DOCUMENTS

| | | | |
|---|---|---|---|
| 2006/0120651 | A1 | 6/2006 | Ochi |
| 2015/0233267 | A1 | 8/2015 | Dupke |
| 2016/0265394 | A1 | 9/2016 | Brune |

FOREIGN PATENT DOCUMENTS

| | | | |
|---|---|---|---|
| JP | H04259612 | A | 9/1992 |
| JP | 2006138373 | A | 6/2006 |
| JP | 2008115818 | A | 5/2008 |
| JP | 2009079569 | A | 4/2009 |
| JP | 2013029027 | A | 2/2013 |
| WO | 2014053124 | A1 | 4/2014 |

OTHER PUBLICATIONS

Non-Final Office Action issued in U.S. Appl. No. 15/065,644 dated Aug. 24, 2017 (12 pages).

Final Office Action issued in U.S. Appl. No. 15/065,644 dated Feb. 5, 2018 (10 pages).

Communication dated Sep. 17, 2018 enclosing the extended European Search Report dated Sep. 5, 2018 for European Patent Application No. 16762506.0.

* cited by examiner

ROCKER ARM ASSEMBLY AND METHOD OF FORMING RETENTION ELEMENTS IN A ROCKER ARM

CROSS-REFERENCE TO RELATED APPLICATIONS

The present application is a continuation-in-part of U.S. application Ser. No. 15/065,644, filed on Mar. 9, 2016, and claims priority to and all the benefits of U.S. Provisional Patent Application No. 62/131,023, filed on Mar. 10, 2015, both of which are hereby expressly incorporated herein by reference in their entirety.

BACKGROUND OF THE INVENTION

1. Field of Invention

The present invention relates, generally, to engine valvetrain systems and, more specifically, to a rocker arm assembly for use in a valvetrain of a cylinder head of an internal combustion engine.

2. Description of the Related Art

Conventional engine valvetrain systems known in the art typically include one or more camshafts in rotational communication with a crankshaft supported in a block, one or more intake and exhaust valves supported in a cylinder head, and one or more intermediate members for translating radial movement from lobes of the camshaft into linear movement of the valves. The valves are used to regulate the flow of gasses in and out of cylinders of the block. To that end, the valves each have a head and a stem extending therefrom. The valve head is configured to periodically seal against the cylinder head. To that end, a compression spring is typically supported in the cylinder head, is disposed about the valve stem, and is operatively attached to the valve stem via a spring retainer. The valve stem is typically supported by a valve guide that is also operatively attached to the cylinder head, whereby the valve stem extends through the valve guide and travels therealong in response to engagement from the intermediate member.

As the camshaft rotates, the intermediate member translates force from the lobes into linear movement of the valve between two different positions, commonly referred to as "valve open" and "valve closed". In the valve closed position, potential energy from the loaded spring holds the valve head sealed against the cylinder head. In the valve opened position, the intermediate member translates linear movement to compress the spring, thereby un-sealing the valve head from the cylinder head so as to allow gasses to flow into (or, out of) the cylinder of the block.

During engine operation, and particularly at high engine rotational speeds, close tolerance must me maintained between the camshaft lobe, the intermediate member, and the valve stem. Excessive tolerance results in detrimental engine performance as well as increased wear of the various valvetrain components, which leads to significantly decreased engine life. In order to maintain proper tolerances, in modern "overhead cam" valvetrain systems, the intermediate member is typically realized by a lash adjuster and a rocker arm. The lash adjuster is typically supported in the cylinder head spaced from the valve stem, with a lobe of the camshaft disposed above ("overhead of") the lash adjuster and valve stem. Conventional lash adjusters utilize hydraulic oil pressure from the engine to maintain tolerances between the valve stem and the camshaft lobe under varying engine operating conditions, such as engine rotational speed or operating temperature.

Thus, in operation, force from the camshaft lobe is translated through the rocker arm to the lash adjuster and the valve stem. To that end, the rocker arm extends between and engages the lash adjuster and the valve stem, and also includes a bearing that engages the camshaft lobe. The bearing is typically supported by a shaft that is fixed to the rocker arm. The bearing rotates on the shaft, follows the profile of the lobe of the camshaft, and translates force to the rocker arm, via the shaft, so as to open the valve.

Each of the components of an engine valvetrain system of the type described above must cooperate to effectively translate movement from the camshaft so as to operate the valves properly at a variety of engine rotational speeds and operating temperatures and, at the same time, maintain correct valvetrain tolerances. In addition, each of the components must be designed not only to facilitate improved performance and efficiency, but also so as to reduce the cost and complexity of manufacturing and assembling the valvetrain system, as well as reduce wear in operation. While engine valvetrain systems known in the related art have generally performed well for their intended purpose, there remains a need in the art for an engine valvetrain system that has superior operational characteristics, and, at the same time, reduces the cost and complexity of manufacturing the components of the system.

SUMMARY OF THE INVENTION

The present invention overcomes the disadvantages in the related art in a rocker arm assembly for use in an internal combustion engine valvetrain having a valve, a lash adjuster, and a camshaft having a lobe. The rocker arm assembly includes a shaft, a bearing rotatably supported by the shaft for engaging the lobe of the camshaft, and a rocker arm. The rocker arm has a pad for engaging the valve, and a socket spaced from the pad for engaging the lash adjuster. A pair of walls are disposed between the pad and the socket. Each of the walls has an inner wall surface and an outer wall surface. The walls define a valley between the inner wall surfaces for accommodating the shaft. A pair of upwardly-opening arc-shaped bearing surfaces are disposed longitudinally between the pad and the socket and are spaced laterally from each other. The arc-shaped bearing surfaces rotatably support the shaft when the bearing engages the lobe of the camshaft. A retention element is formed in each of the side walls with a depressed portion spaced laterally from the outer wall surface, and a lip portion arranged under the depressed portion and extending from the wall at least partially into the valley. The lip portions of the retention elements are disposed in spaced relation above the arc-shaped bearing surfaces such that the shaft is prevented from moving out of the valley in absence of engagement between the bearing and the lobe of the camshaft.

In addition, the present invention is also directed towards a method of forming a retention element in a rocker arm of a rocker arm assembly having a shaft and a bearing rotatably supported by the shaft for engaging the lobe of a camshaft of an internal combustion engine valvetrain. The valvetrain further includes a valve and a lash adjuster. The method includes the steps of: providing a rocker arm having: a pad for engaging the valve; a socket spaced from the pad for engaging the lash adjuster; a pair of walls disposed between the paid and the socket with each of the walls having an inner wall surface and an outer wall surface, the walls defining a valley between the inner wall surfaces for accommodating the shaft; and a pair of upwardly-opening arc-shaped bearing surfaces spaced laterally from each other and disposed longitudinally between the pad and the socket for rotatably supporting the shaft when the bearing engages the lobe of the camshaft; providing a tool having: a shank extending to a shank end; an insertion portion extending longitudinally from the shank end; and a pair of braces extending from the shank laterally away from each other and arranged longitudinally adjacent to the shank end, the braces each having a tip surface with a protrusion extending laterally therefrom towards the insertion portion; positioning the insertion portion of the tool above the arc-shaped bearing surfaces of the rocker arm; and urging the insertion portion of the tool towards the arc-shaped bearing surfaces of the rocker arm so as to bring at least a portion of the braces of the tool into engagement with the walls of the rocker arm to form a retention element in each of the walls.

In this way, the present invention significantly reduces the complexity and packaging size of the valvetrain system and its associated components. Moreover, the present invention reduces the cost of manufacturing valvetrain systems that have superior operational characteristics, such as improved engine performance, control, lubrication, efficiency, as well as reduced vibration, noise generation, engine wear, and packaging size.

BRIEF DESCRIPTION OF THE DRAWINGS

Other objects, features, and advantages of the present invention will be readily appreciated as the same becomes better understood after reading the subsequent description taken in connection with the accompanying drawing wherein.

DETAILED DESCRIPTION OF THE INVENTION

Figure 1:
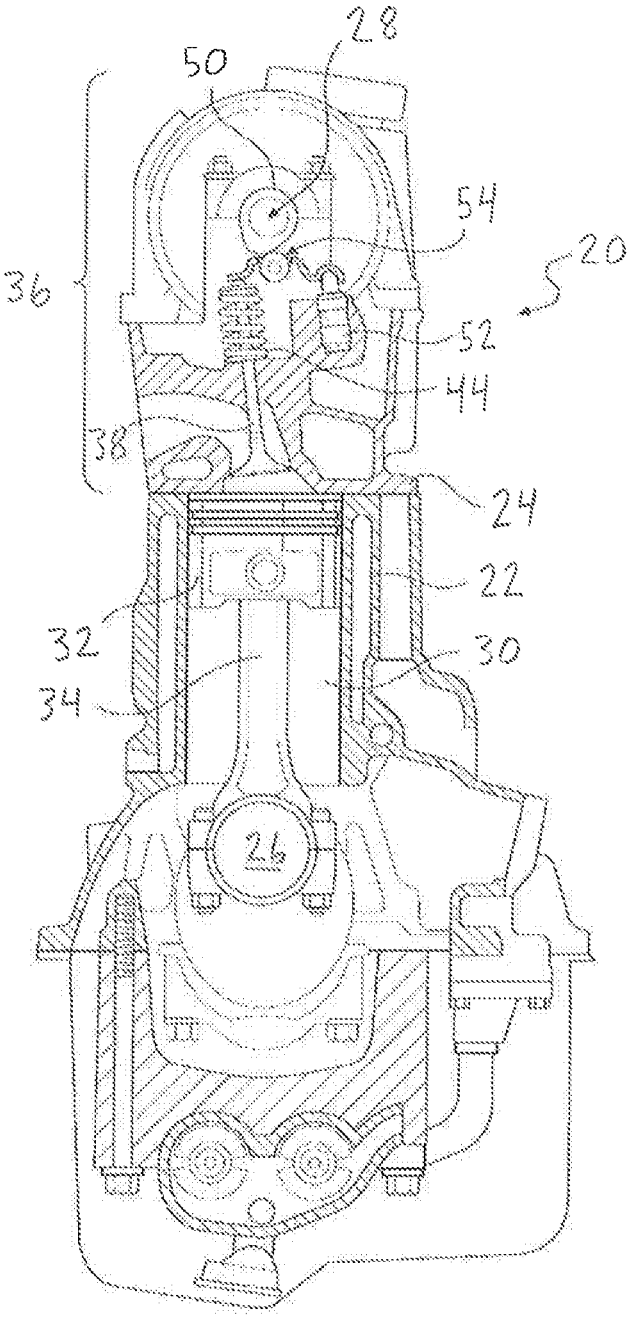
FIG. 1 is a partial front sectional view of an automotive engine with an overhead-cam configuration including a valvetrain mounted in a cylinder head.

Referring now to the drawings, where like numerals are used to designate like structure, a portion of an internal combustion engine is illustrated at 20 in FIG. 1. The engine 20 includes a block 22 and a cylinder head 24 mounted to the block 22. A crankshaft 26 is rotatably supported in the block 22, and a camshaft 28 is rotatably supported in the block 22 spaced from the crankshaft 26. The crankshaft 26 drives the camshaft 28 via a timing chain or belt (not shown, but generally known in the art). The block 22 typically includes one or more cylinders 30 in which a piston 32 is supported for reciprocal motion therealong. The piston 32 is pivotally connected to a connecting rod 34, which is also connected to the crankshaft 26. In operation, combustion in the cylinders 30 of the engine 20 moves the pistons 22 in reciprocal fashion within the cylinders 30.

Figure 2:
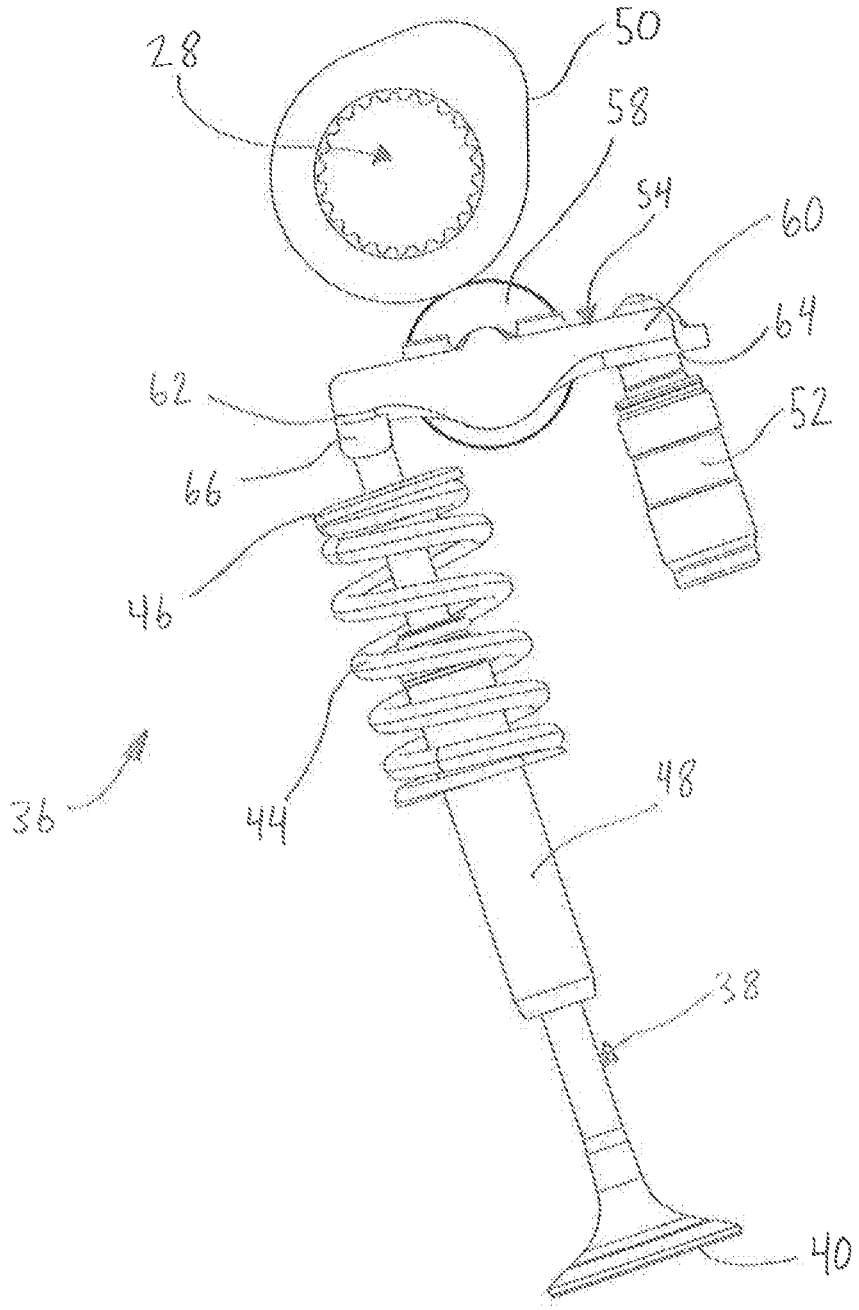
FIG. 2 is a front view of a portion of the valvetrain of FIG. 1 showing a valve, a camshaft, a lash adjuster, and a rocker arm assembly according to one embodiment of the present invention.
Figure 3:
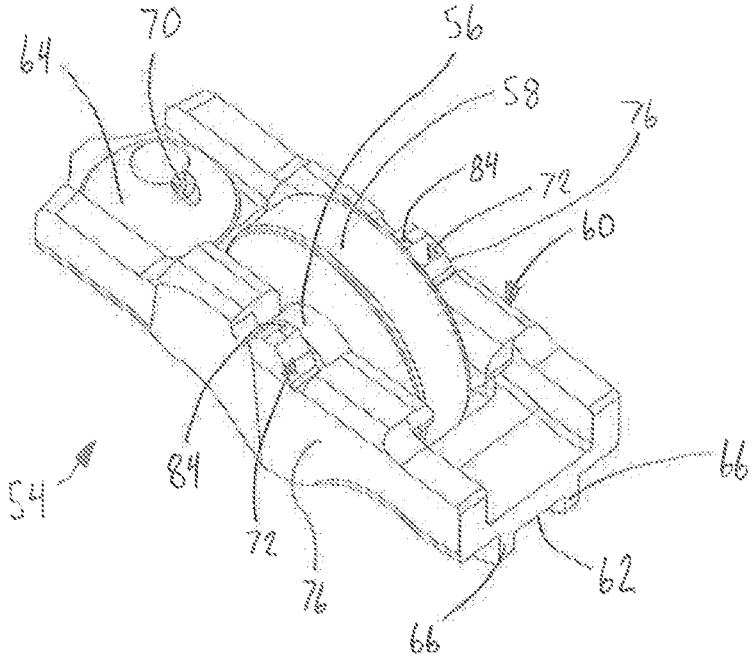
FIG. 3 is a perspective view of a first embodiment of the rocker arm assembly according to the present invention including a shaft, a bearing, and a rocker arm.

Reciprocal motion of the piston 32 generates rotational torque that is subsequently translated by the crankshaft 26 to the camshaft 28 which, in turn, cooperates with a valvetrain, generally indicated at 36, to control the flow and timing of intake and exhaust gasses between the cylinder head 24, the cylinders 30, and the outside environment. Specifically, the camshaft 28 controls what is commonly referred to in the art as "valve events," whereby the camshaft 28 effectively actuates valves 38 supported in the cylinder head 24 at specific time intervals with respect to the rotational position of the crankshaft 26, so as to effect a complete thermodynamic cycle of the engine 20. To that end, the valves 38 each have a head 40 and a stem 42 extending therefrom (see FIG. 2). The valve head 40 is configured to periodically seal against the cylinder head 24 adjacent the cylinder 30, such as with a compression spring 44 supported in the cylinder head 24, disposed about the valve stem 42, and operatively attached to the valve 38 via a retainer 46. The valve stem 42 is typically supported by a valve guide 48 that is also operatively attached to the cylinder head 24, whereby the valve stem 42 extends through the valve guide 48 and travels therealong in response to force translated via rotation of the camshaft 28 (see FIG. 2). To this end, the camshaft 28 has lobes 50 with a predetermined profile configured to cooperate with the valvetrain 36 such that radial movement from the camshaft 28 is translated into linear movement of the valves 38 so as to control the valve events, as discussed above. More specifically, the valvetrain 36 also includes a lash adjuster 52 and a rocker arm assembly, generally indicated at 54 and according to the present invention. Conventional lash adjusters 52 utilize hydraulic oil pressure from the engine 20 to maintain tolerances between the valve stem 42 and the camshaft lobe 50 under varying engine operating conditions, such as engine rotational speed or operating temperature. To that end, the lash adjuster 52 is supported in the cylinder head 24 and is spaced from the valve stem 42 and cooperates with the rocker arm assembly 54 to effect translation of force to the valve 38, as will be described in greater detail below. While the lash adjuster 52 shown in FIGS. 1 and 2 is a hydraulic lash adjuster, it will be appreciated that the lash adjuster 52 could be of any suitable type or configuration without departing from the scope of the present invention.

Those having ordinary skill in the art will recognize the valvetrain 36 described herein as forming what is commonly referred as an "overhead cam" configuration, whereby rotation of the camshaft 28 is translated to the rocker arm assembly 54 which, in turn, engages and directs force to the valve 38 and the lash adjuster 52. While the engine 20 illustrated in FIG. 1 is an inline-configured, single overhead cam, spark-ignition, Otto-cycle engine, those having ordinary skill in the art will appreciate that the engine 20 could be of any suitable configuration, with any suitable number of cylinder heads 24 and/or camshafts 28 disposed in any suitable way, controlled using any suitable thermodynamic cycle, and with any suitable type of valvetrain 36, without departing from the scope of the present invention. By way of non-limiting example, the engine 20 could be a so-called "dual overhead-cam V8" with an eight-cylinder V-configured block 22 and a pair of cylinder heads 24 each supporting a respective pair of camshafts 28 (not shown, but generally known in the art). Further, while the engine 20 is configured for use with automotive vehicles, those having ordinary skill in the art will appreciate that the present invention could be used in any suitable type of engine 20. By way of non-limiting example, the present invention could be used in connection with passenger or commercial vehicles, motorcycles, all-terrain vehicles, lawn care equipment, heavy-duty trucks, trains, airplanes, ships, construction vehicles and equipment, military vehicles, or any other suitable application without departing from the scope of the present invention.

As noted above, the present invention is directed toward a rocker arm assembly 54 for use in the engine 20 valvetrain 36. More specifically, the rocker arm assembly 54 cooperates with the valve 38, the lobe 50 of the camshaft 28, and the lash adjuster 52. As will be appreciated from the subsequent description below, the rocker arm assembly 54 can be configured in a number of different ways without departing from the scope of the present invention.

Referring now to FIGS. 3-7, the rocker arm assembly 54 of the present invention is shown. The rocker arm assembly 54 includes a shaft 56, a bearing 58, and a rocker arm, generally indicated at 60. The bearing 58 is rotatably supported by the shaft 56 and is adapted to engage the lobe 50 of the camshaft 28. More specifically, the bearing 58 follows the profile of the lobe 50 such that when the camshaft 28 rotates, force is translated to the bearing 58 which simultaneously rotates the bearing 58 about the shaft 56 and urges the bearing 58 away from the camshaft 28 toward the valve 38 and the lash adjuster 52. While the representative embodiment of the rocker arm assembly 54 depicted throughout the drawings employs a conventional journal bearing arrangement with the bearing 58 supported directly on the shaft 56, those having ordinary skill in the art will appreciate that the bearing 58 could be indirectly supported on the shaft 56, such as with a plurality of needle bearing elements (not shown) interposed between the shaft and the bearing in a conventional needle bearing arrangement. However, those having ordinary skill in the art will appreciate that any suitable bearing arrangement could be utilized, with or without the use of needle bearing elements, without departing from the scope of the present invention.

It will be appreciated that force which urges the bearing 58 away from the camshaft 28 is translated to the rocker arm 60 via the shaft 56, whereby the rocker arm 60 subsequently translates force to the lash adjuster 52 and the valve stem 42 to open the valve 38 so as to control the flow of gasses into (or, out of) the cylinder 30, as discussed above. To that end, the rocker arm 60 includes a pad 62 for engaging the valve 38, and a socket 64 spaced from the pad 62 for engaging the lash adjuster 52. The pad 62 and the socket 64 are adapted to press against and remain substantially engaged to the valve 38 and the lash adjuster 52, respectively, as the camshaft 28 rotates in operation (see also FIG. 2). In one embodiment, the rocker arm 60 also includes a pair of pad braces 66 depending from the pad 62 that help align the rocker arm assembly 54 to the valve 38, such as during installation of the rocker arm assembly 54 into the cylinder head 24. Similarly, the socket 64 has a curved pocket 68 for accommodating and aligning with a portion of the lash adjuster 52 (not shown in detail, but generally known in the art). In the representative embodiment illustrated herein, the rocker arm 60 also includes a lubrication port, generally indicated at 70, formed through the socket 64 and in communication with the curved pocket 68 for directing lubricating oil from to lash adjuster 52 towards the bearing 58 and the shaft 56 in operation. However, those having ordinary skill in the art will appreciate that the pad 62 and/or socket 64 could be configured in any suitable way without departing from the scope of the present invention.

Figure 4:
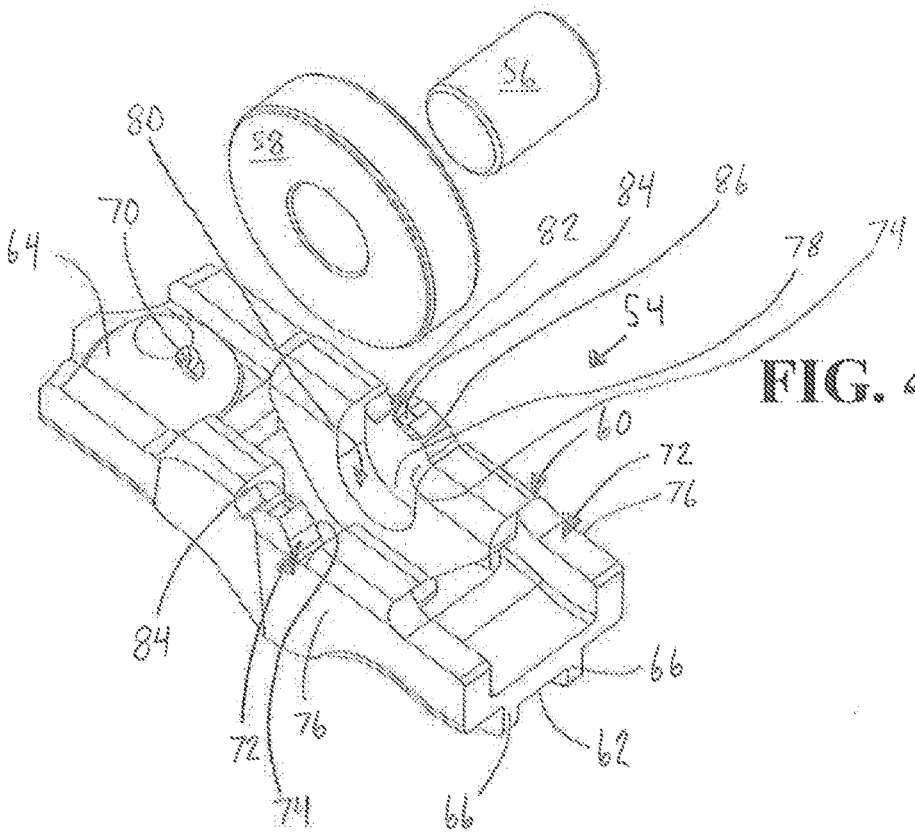
FIG. 4 is an exploded perspective view of the rocker arm assembly of FIG. 3.
Figure 5:
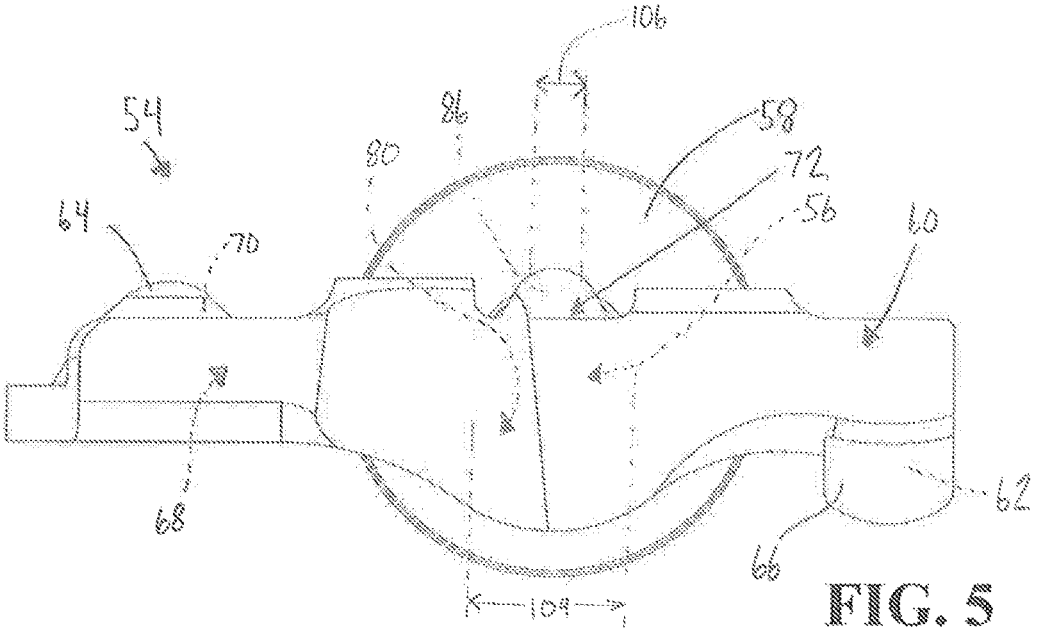
FIG. 5 is a front plan view of the rocker arm assembly of FIG. 3 with the shaft, a portion of the bearing, and internal features and structure of the rocker arm shown in phantom.
Figure 6:
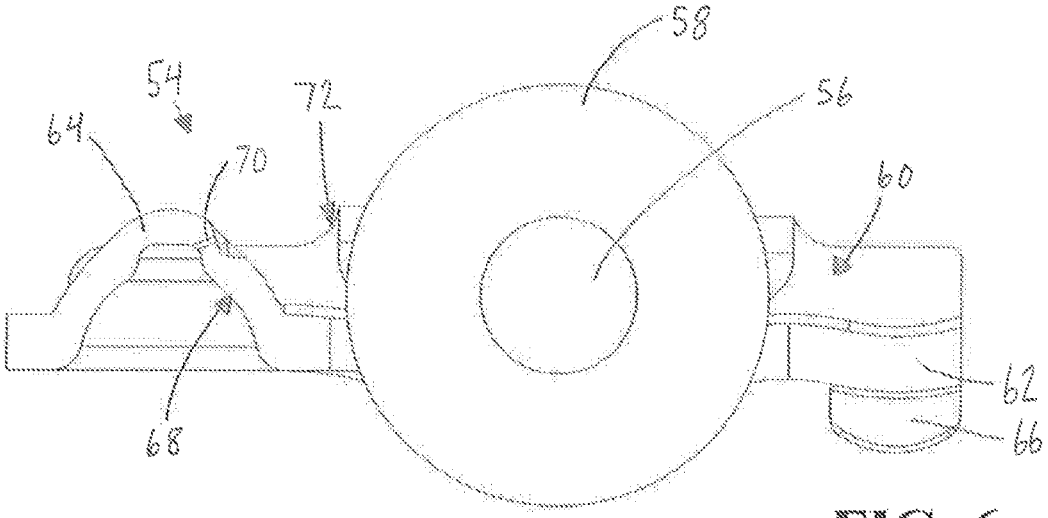
FIG. 6 is a sectional view taken along a longitudinal centerline of the rocker arm assembly of FIG. 3.
Figure 7:
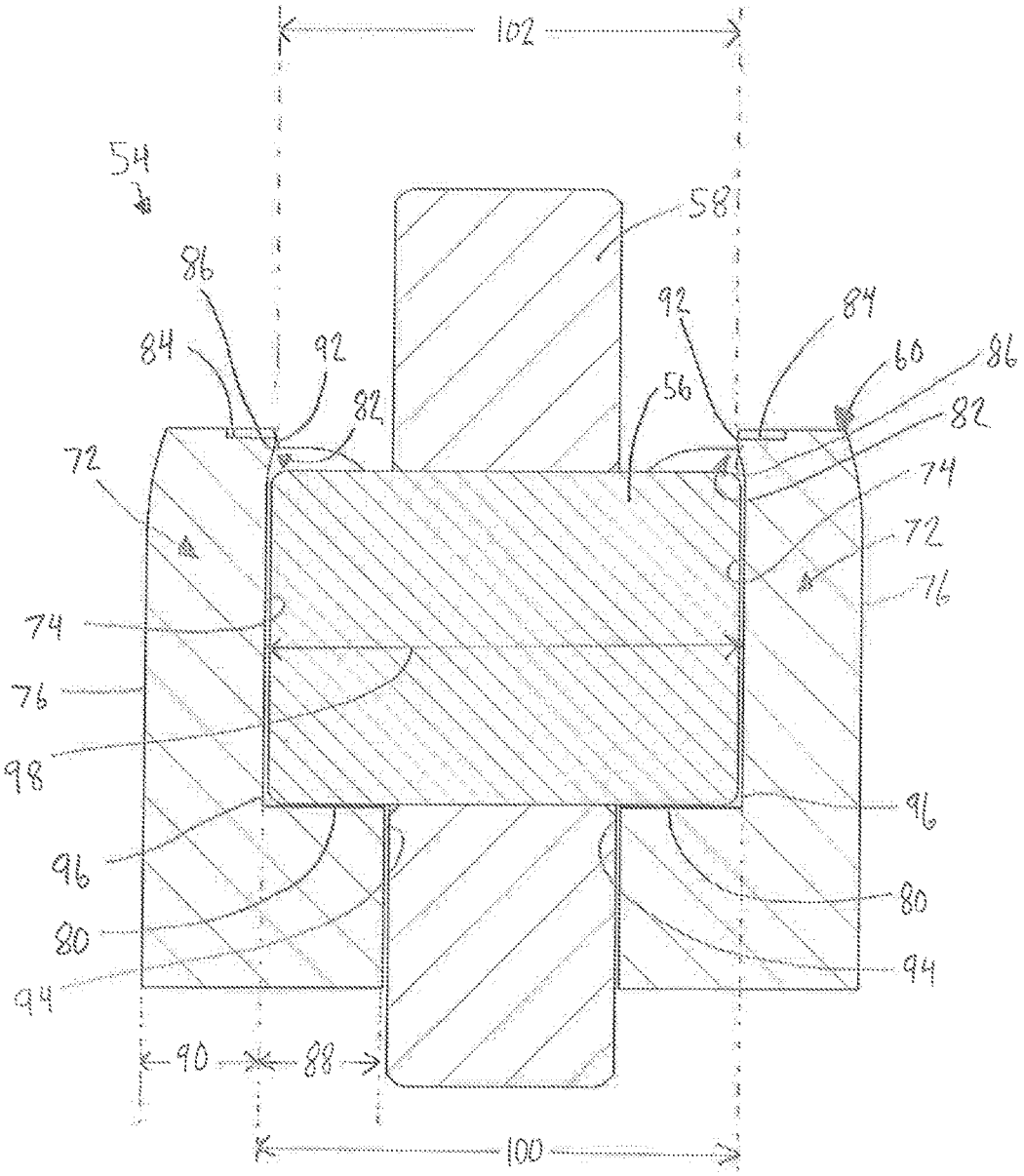
FIG. 7 is a sectional view taken along a lateral centerline of the shaft of the rocker arm assembly of FIG. 3.

As is shown best in FIG. 4, the rocker arm 60 includes a pair of walls 72 disposed between the pad 62 and the socket 64. The walls 72 each have an inner wall surface 74 and an outer wall surface 76. The walls 72 define a valley, generally indicated at 78, between the inner wall surfaces 74 for accommodating the shaft 56. The rocker arm 60 also includes a pair of upwardly-opening arc-shaped bearing surfaces, generally indicated at 80. The arc-shaped bearing surfaces 80 are spaced laterally from each other and are disposed longitudinally between the pad 62 and the socket 64. The arc-shaped bearing surfaces 80 rotatably support the shaft 56 when the bearing 58 engages the lobe 50 of the camshaft 28, as is described in greater detail below. The rocker arm 60 also includes a pair of retention elements 82 formed in each of the walls 72 with a depressed portion 84 spaced laterally from the outer wall surface 76 and a lip portion 86 arranged under the depressed portion 84 and extending from the wall 72 at least partially into the valley 78. The lip portions 86 of the retention elements 82 are disposed in spaced relation above the arc-shaped bearing surfaces 80 such that the shaft 56 is prevented from moving out of the valley 78 in absence of engagement between the bearing 58 and the lobe 50 of the camshaft 28.

When the rocker arm assembly 54 is installed into the cylinder head 24 and engages the lobe 50 of the camshaft 28, a certain amount of pre-load force is exerted against the bearing 58 which, in turn, pushes the shaft 56 against the arc-shaped bearing surfaces 80, thereby pushing the rocker arm 60 against the valve 38 and the lash adjuster 52. This pre-load force keeps the shaft 56 against the arc-shaped bearing surfaces 80 in operation. As such, the shaft 56 need only be radially supported by the rocker arm 60 and not radially constrained. To this end, the retention elements 82 keep the shaft 56 in the valley 78 until the rocker arm assembly 54 is installed; specifically, until the bearing 58 engages the lobe 50 of the camshaft 28. In one embodiment, the retention elements 82 are spaced above the shaft 56 when the shaft engages the arc-shaped bearing surfaces 80 (see FIG. 7).

In the embodiments illustrated throughout the figures, the rocker arm 60 is formed as a unitary, one-piece component. More specifically, the rocker arm 60 is manufactured from a single piece of sheet steel that is stamped and bent to shape and the retention elements 82 subsequently formed therein, as described in greater detail below. Thus, as shown best in FIG. 7, the arc-shaped bearing surfaces 80 each have a bearing width 88 that is substantially equal to a wall width 90 of the walls 72. However, those having ordinary skill in the art will appreciate that the rocker arm 60 could be formed or otherwise manufactured in any suitable way from any suitable material without departing from the scope of the present invention.

Figure 8:
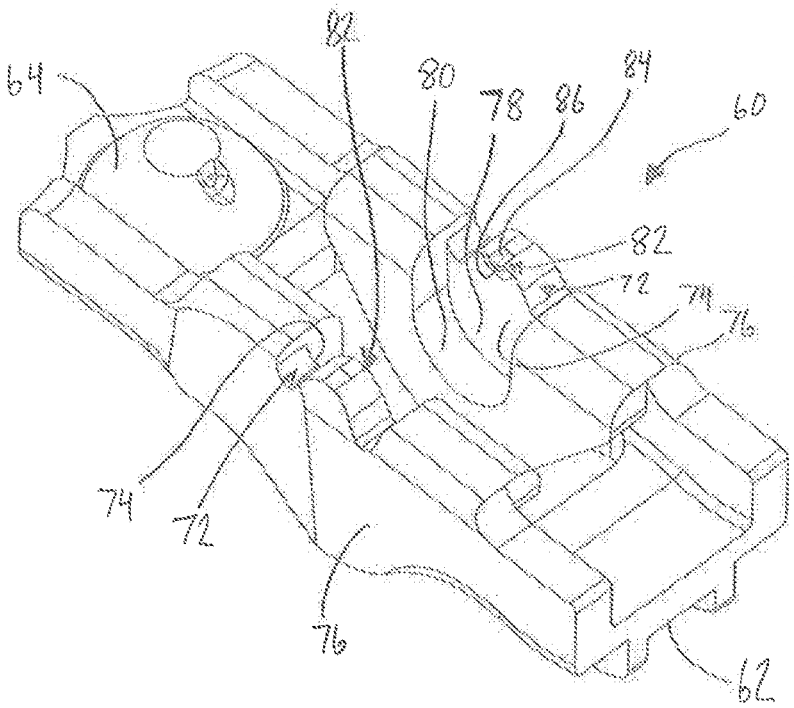
FIG. 8 is a perspective view of the rocker arm of FIG. 3 shown having retention elements formed according to one embodiment of the present invention.
Figure 9:
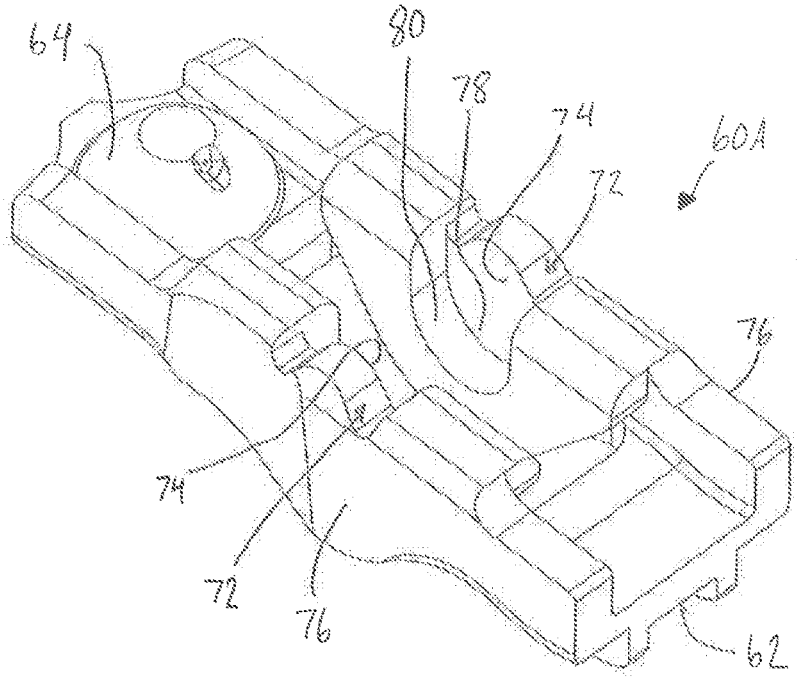
FIG. 9 is a perspective view of the rocker arm of FIG. 8 shown prior to formation of the retention elements.
Figure 10:
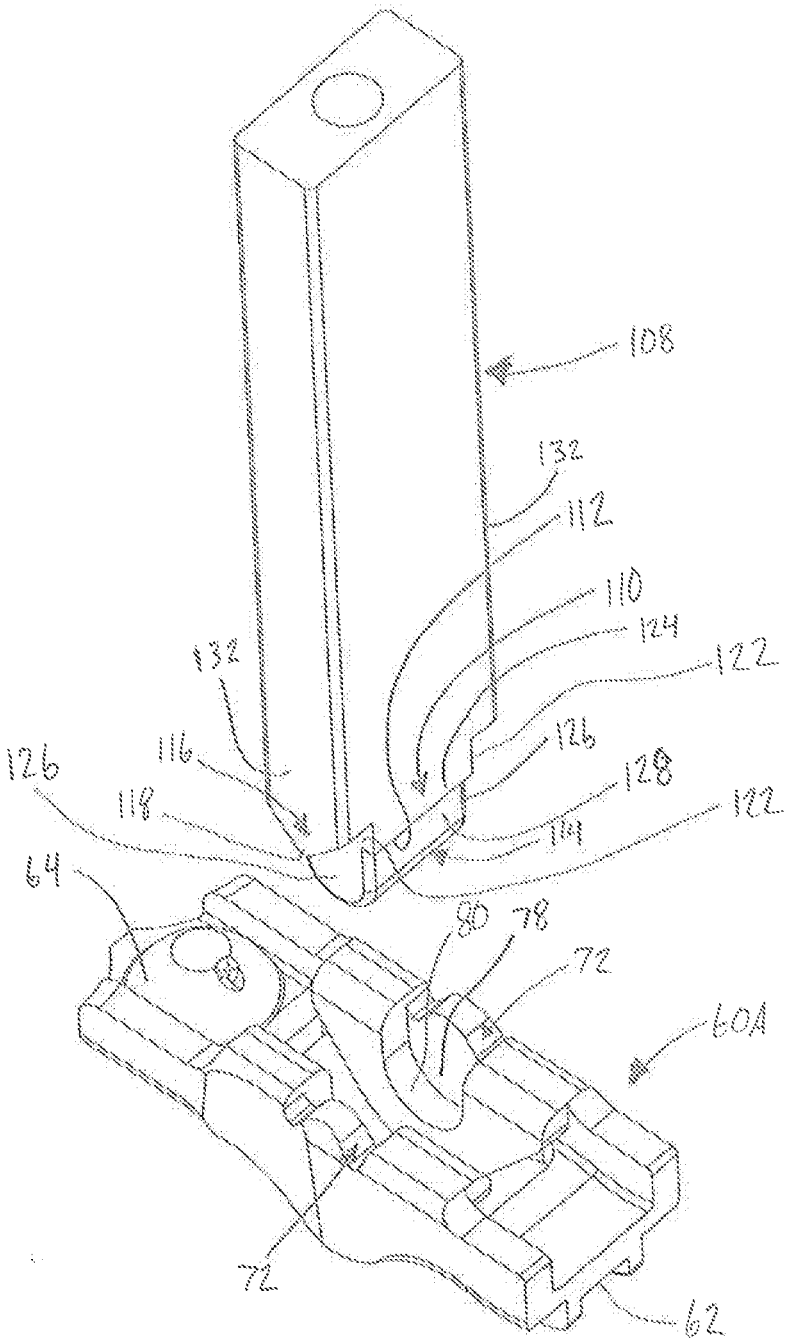
FIG. 10 is a perspective view of the rocker arm of FIG. 9 shown adjacent to a tool for forming the retention elements depicted in FIG. 8 according to one embodiment of the present invention.
Figure 11:
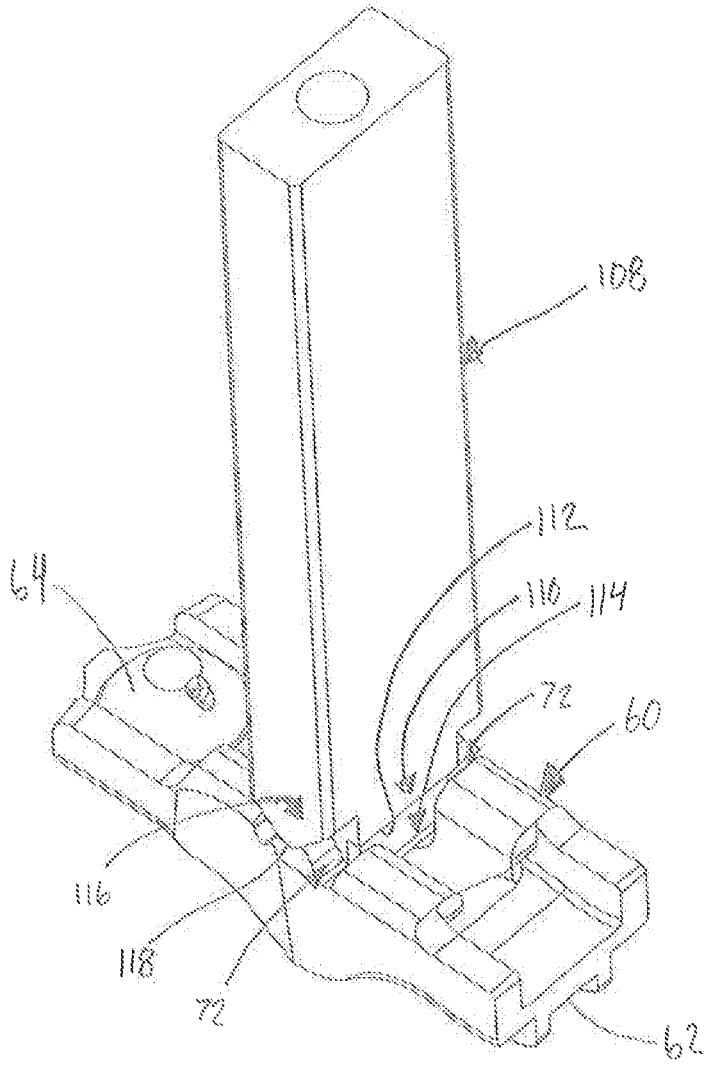
FIG. 11 is a perspective view of the rocker arm and tool of FIG. 10 shown with the tool engaging the rocker arm to form the retention elements depicted in FIG. 8.
Figure 12:
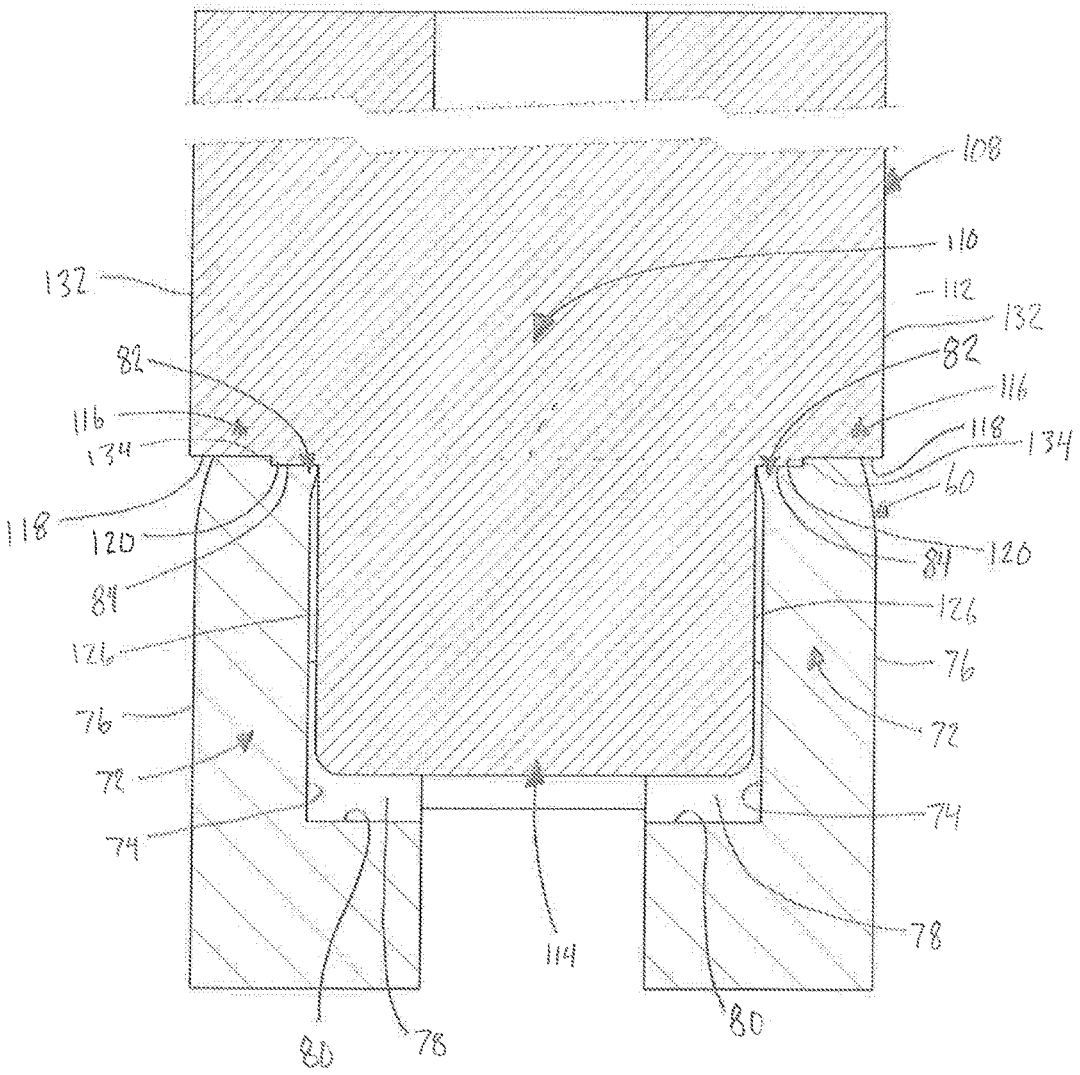
FIG. 12 is a broken sectional view taken along a lateral centerline of the rocker arm assembly and the tool of FIG. 11 depicting formation of the retention elements by the tool.

As noted above, the retention elements 82 extend from the walls 72 into the valley 78. As shown best in FIGS. 4 and 7, in one embodiment, the retention elements 82 each extend from one of the inner wall surfaces 74 of the walls 72 to a respective retention element edge 92, with the lip portions 86 merging the each of the retention element edges 92 with the respective walls 72. As shown best in FIG. 7, the lip portions 86 have a substantially curved profile. Similarly, as best shown in FIGS. 4 and 8, in one embodiment, the depressed portions 84 of the retention elements 82 of the rocker arm 60 have a substantially cylindrical profile. In one embodiment, the arc-shaped bearing surfaces 80 each have an inner lateral edge 94 and an outer lateral edge 96, and the retention element edges 92 are each positioned: laterally between the inner lateral edge 94 and the outer lateral edge 96 of the respective arc-shaped bearing surface 80; and vertically above the respective arc-shaped bearing surfaces 80 (see FIG. 7). However, it will be appreciated that the edges 92, 94, 96 and/or the lip portion 86 be configured in a number of different ways, without departing from the scope of the present invention. By way of non-limiting example, while the upwardly-opening arc-shaped bearing surfaces 80 are each formed with a generally U-shaped surfaces having a single radius of curvature, it will be appreciated that the bearing surfaces 80 could be defined by any suitable arrangement of continuous or discrete surfaces which cooperate to rotatably support the shaft 56 in response to engagement between the bearing 58 and the lobe 50 of the camshaft 28, without departing from the scope of the present invention. Moreover, it will be appreciated the retention elements 82 could be configured in any suitable way sufficient to keep the shaft 56 in the valley 78 until the bearing 58 engages the lobe 50 of the camshaft 28 without departing from the scope of the present invention.

As noted above, the shaft 56 rotates with respect to the arc-shaped bearing surfaces 80. By allowing the shaft 56 to rotate independent from the bearing 58, spalling is substantially eliminated that may otherwise occur between the shaft 56 and the bearing 58 and/or arc-shaped bearing surfaces 80. Thus, the rocker arm assembly 54 can be designed to optimize material and/or application specifications so as to decrease cost and maximize component life. In addition to rotating with respect to the rocker arm 60, the shaft 56 may also be configured to move axially with respect to the rocker arm 60 so as to further reduce wear and increase component life. To that end, in one embodiment, the shaft 56 has a shaft length 98, the rocker arm 60 has an arc outer lateral edge distance 100 measured between the outer lateral edges 96 of the arc-shaped bearing surfaces 80, and the shaft length 98 is less than the arc outer lateral edge distance 100 (see FIG. 7). Similarly, in one embodiment, the rocker arm 60 has a retention element distance 102 measured between the retention element edges 92 of the retention elements 82, and the shaft length 98 is less than the retention element distance 102. Further, in one embodiment, the shaft 56 has a shaft diameter 104 and the retention elements of the rocker arm 60 each have a longitudinal element width 106 that is less than the shaft diameter 56 (see FIG. 5). These relationships help ensure that the shaft 56 remains within the valley 78 while, at the same time, allowing for rotation and slight axial movement so as to optimize performance and component life, as discussed above. In the representative embodiment illustrated herein, the retention elements 82 are similarly shaped and, thus, have substantially equivalent longitudinal element widths 106. However, as noted above, the retention elements 82 could be configured in any suitable way, with the same or different configurations from one another, without departing from the scope of the present invention.

Figure 13:
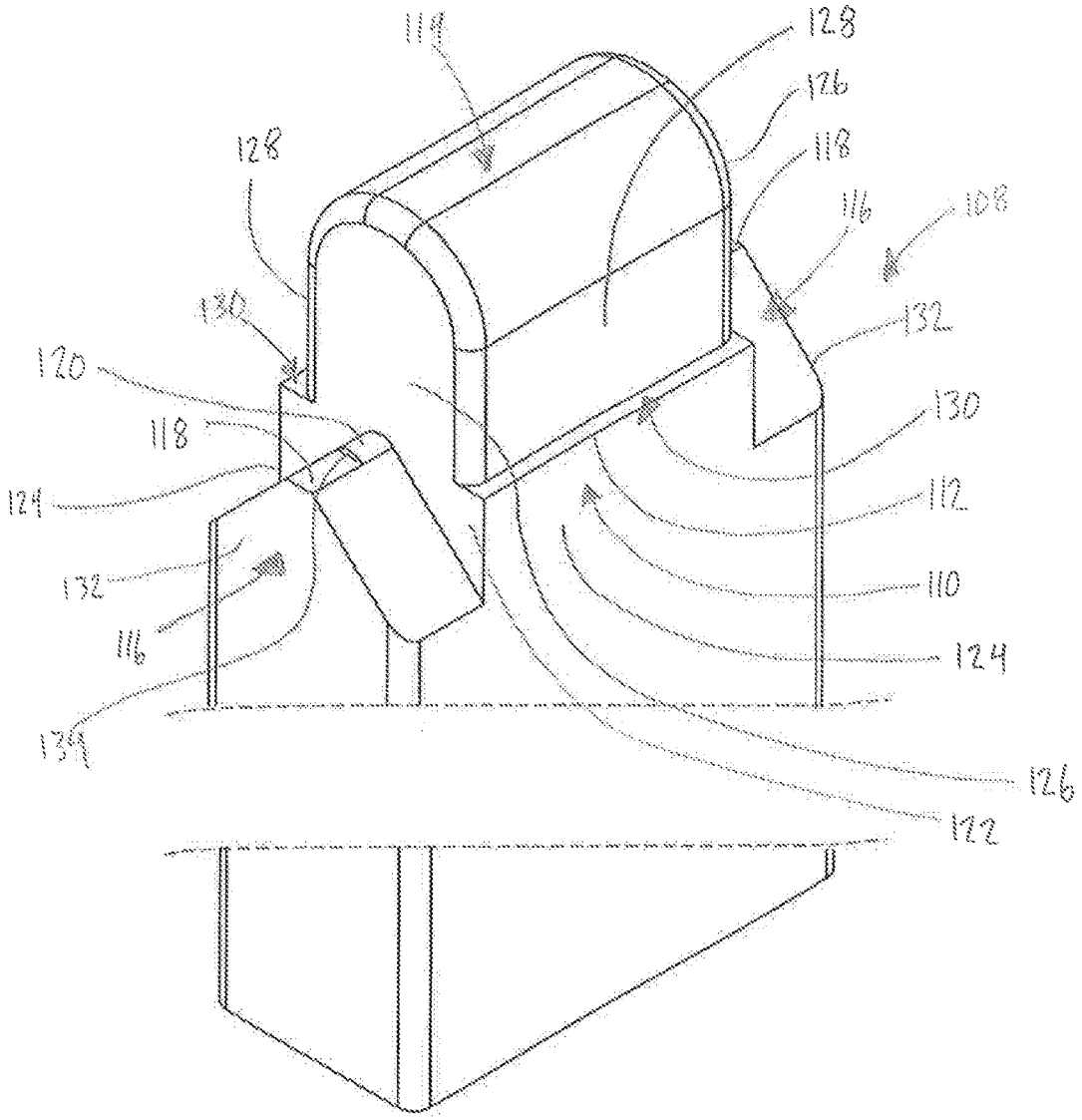
FIG. 13 is a broken perspective view of the tool of FIGS. 10-12.

Referring now to FIGS. 8-13, as noted above, the present invention is also directed towards a method of forming the retention elements 82 in the rocker arm 60 of the rocker arm assembly 54. To that end, the method concerns forming retention elements 82 in an unfinished rocker arm 60A (see FIG. 9 and compare to FIG. 8) using a tool, generally indicated at 108 (see FIGS. 10-13), as is described in greater detail below. As is best shown in FIG. 13, the tool 108 has a shank 110 which extends to a shank end 112, an insertion portion 114 extending longitudinally from the shank end 112, and a pair of braces 116 extending from the shank 110 laterally away from each other. Here, the braces 116 are arranged longitudinally adjacent to the shank end 112, and each has a tip surface 118 with a protrusion 120 extending laterally therefrom towards the insertion portion 114. Once the unfinished rocker arm 60A and the tool 108 are provided, the method includes the steps of positioning the insertion portion 114 of the tool 108 above the arc-shaped bearing surfaces 80 of the unfinished rocker arm 60A (see FIG. 10), and then urging the insertion portion 114 of the tool 108 towards the arc-shaped bearing surfaces 80 of the unfinished rocker arm 60A (see FIG. 11) so as to bring at least a portion of the braces 116 of the tool 108 into engagement with the walls 72 of the unfinished rocker arm 60A to form a retention element 82 in each of the walls 72 of the rocker arm 60 (see FIGS. 12 and 8). In one embodiment, the protrusions 120 of the braces 116 are brought into engagement with the walls 72 of the unfinished rocker arm 60A to form the depressed portion 84 and the lip portion 86, as described above.

With reference again to FIG. 13, the shank end 112 of the shank 110 has a generally rectangular profile, and the insertion portion 114 has a generally inverted U-shaped profile extending longitudinally from the shank end 112. In the representative embodiment illustrated herein, the shank 110 has first and second pairs of shank sides 122, 124, and the insertion portion 114 has first and second pairs of insertion sides 126, 128. The first pair of shank sides 122 are formed integrally with the first pair of insertion sides 126, and the second pair of insertion sides 128 are spaced inwardly from the second pair of shank sides 124 so as to define a pair of steps 130. Here, the insertion portion 114 is shaped to be accommodated in the valley 78, and may advantageously be spaced from the arc-shaped bearing surfaces 80, while the retention elements 82 are being formed (see also FIG. 12). The braces 116 have a generally inverted V-shaped profile extending laterally outwardly from the first pair of shank sides 122 to respective brace sides 132. The protrusions 120 similarly extend laterally outwardly from the first pair of shank sides 122 and terminate at respective protrusion sides 134 spaced laterally between the respective first shank side 122 and brace side 132.

In the representative embodiment illustrated herein, the tip surfaces 118 are aligned with the shank end 112, and the protrusions 120 extend from the respective tip surfaces 118, longitudinally away from the shank 110. Here, the protrusions 120 and the tip surfaces 118 are shaped to form the depressed portion 84 and, thus, the lip portion 86 in response to engagement with the walls 72 of the unfinished rocker arm 60A, whereby the protrusions 120 form the complimentarily-shaped cylindrical depressed portions 84 with the top surface 118 abutting the wall 72 adjacent thereto (see FIG. 12).

In this way, the rocker arm assembly 54 and method of the present invention significantly reduces the cost and complexity of manufacturing and assembling the valvetrain 36 and associated components. Specifically, it will be appreciated that the configuration of the retention elements 82 enables consistent and simple installation of the shaft 56 to the rocker arm 60 while, at the same time, ensuring that the shaft 56 is kept within the valley 78 until the bearing 58 engages the lobe 50 of the camshaft 28. Specifically, it will be appreciated that the configuration of the rocker arm assembly 54 allows the shaft 56 to be retained with respect to the rocker arm 60 until the rocker arm assembly 54 is installed in the cylinder head 24, thereby significantly reducing the cost and complexity of manufacturing and assembling the valvetrain 36. Further, it will be appreciated that the present invention affords opportunities for superior engine 20 operational characteristics, such as improved performance, component life and longevity, efficiency, weight, load and stress capability, and packaging orientation.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A rocker arm assembly for use in an internal combustion engine valvetrain having a valve, a lash adjuster, and a camshaft having a lobe; said rocker arm assembly comprising:

a shaft;

a bearing rotatably supported by said shaft for engaging the lobe of the camshaft; and a rocker arm having:

a pad for engaging the valve, a socket spaced from said pad for engaging the lash adjuster, a pair of walls disposed between said pad and said socket with each of said walls having an inner wall surface and an outer wall surface, said walls defining a valley between said inner wall surfaces for accommodating said shaft, a pair of upwardly-opening arc-shaped bearing surfaces spaced laterally from each other and disposed longitudinally between said pad and said socket for rotatably supporting said shaft when said bearing engages the lobe of the camshaft, and a retention element formed in each of said walls with a depressed portion having an upwardly opening substantially cylindrical profile spaced laterally from said outer wall surface and a lip portion arranged under said depressed portion and extending from said wall at least partially into said valley, said lip portions of said retention elements being disposed in spaced relation above said arc-shaped bearing surfaces such that said shaft is prevented from moving out of said valley in absence of engagement between said bearing and the lobe of the camshaft.

2. The rocker arm assembly as set forth in claim 1, wherein said lip portions of said rocker arm have a substantially curved profile.

3. The rocker arm assembly as set forth in claim 1, wherein said lip portions of said retention elements of said rocker arm are spaced above said shaft when said shaft engages said arc-shaped bearing surfaces.

4. The rocker arm assembly as set forth in claim 1, wherein said retention elements of said rocker arm each extend from one of said inner wall surfaces of said walls to a respective retention element edge, with said lip portions merging said retention element edges with said walls.

5. The rocker arm assembly as set forth in claim 4, wherein said arc-shaped bearing surfaces of said rocker arm each have an inner lateral edge and an outer lateral edge, and wherein said retention element edges are each positioned: above one of said respective arc-shaped bearing surfaces; and laterally between said inner lateral edge and said outer lateral edge of said respective arc-shaped bearing surface.

6. The rocker arm assembly as set forth in claim 4, wherein said shaft has a shaft length less than an arc outer lateral edge distance measured between said outer lateral edges of said arc-shaped bearing surfaces of said rocker arm.

7. The rocker arm assembly as set forth in claim 6, wherein said shaft length is less than a distance measured between said retention elements of said rocker arm.

8. The rocker arm assembly as set forth in claim 1, wherein said shaft has a shaft diameter, and wherein said retention elements of said rocker arm each have a longitudinal element width that is less than said shaft diameter.

9. The rocker arm assembly as set forth in claim 8, wherein said longitudinal element widths of said retention elements of said rocker arm are substantially equal.

10. The rocker arm assembly as set forth in claim 1, wherein said arc-shaped bearing surfaces of said rocker arm each have a bearing width, and wherein said walls each have a wall width that is substantially equal to said bearing width.

11. The rocker arm assembly as set forth in claim 1, wherein said rocker arm is a unitary, one-piece component.

12. The rocker arm assembly as set forth in claim 1, wherein said rocker arm is manufactured from sheet steel.

13. A method of forming a retention element in a rocker arm of a rocker arm assembly having a shaft and a bearing rotatably supported by the shaft for engaging the lobe of a camshaft of an internal combustion engine valvetrain, the valvetrain further including a valve and a lash adjuster, said method comprising the steps of:

providing a rocker arm having: a pad for engaging the valve; a socket spaced from said pad for engaging the lash adjuster; a pair of walls disposed between said paid and said socket with each of said walls having an inner wall surface and an outer wall surface, said walls defining a valley between said inner wall surfaces for accommodating said shaft; and a pair of upwardly-opening arc-shaped bearing surfaces spaced laterally from each other and disposed longitudinally between said pad and said socket for rotatably supporting said shaft when said bearing engages the lobe of the camshaft;

providing a tool having: a shank extending to a shank end; an insertion portion extending longitudinally from said shank end; and a pair of braces extending from said shank laterally away from each other and arranged longitudinally adjacent to said shank end, said braces each having a tip surface with a protrusion extending laterally therefrom towards said insertion portion;

positioning said insertion portion of said tool above said arc-shaped bearing surfaces of said rocker arm; and urging said insertion portion of said tool towards said arc-shaped bearing surfaces of said rocker arm so as to bring at least a portion of said braces of said tool into engagement with said walls of said rocker arm to form a retention element in each of said walls including a depressed portion having an upwardly opening substantially cylindrical profile spaced laterally from said outer wall surface, and a lip portion arranged under said depressed portion and extending from said wall at least partially into said valley.

14. The method as set forth in claim 13, wherein the step of urging said insertion portion of said tool towards said arc-shaped bearing surfaces of said rocker arm includes bringing said protrusions of said braces of said tool into engagement with said walls of said rocker arm to form: the depressed portion having an upwardly opening substantially cylindrical profile spaced laterally from said outer wall surface, and a lip portion arranged under said depressed portion and extending from said wall at least partially into said valley.

* * * * *